United States Patent [19]

Shibuki et al.

[11] Patent Number: 4,462,185

[45] Date of Patent: Jul. 31, 1984

[54] DOOR OPERATING DEVICE FOR A SLIDE DOOR UNIT

[75] Inventors: Osamu Shibuki; Shigeru Sakagami, both of Nagoya; Yoichi Umemura, Anjo, all of Japan

[73] Assignee: Toyota Shatai Kabushiki Kaisha, Aichi, Japan

[21] Appl. No.: 472,862

[22] Filed: Mar. 8, 1983

[30] Foreign Application Priority Data

Mar. 12, 1982 [JP] Japan ..... 57-39699
Jun. 29, 1982 [JP] Japan ..... 57-112007

[51] Int. Cl.[3] ..... E05D 15/10; E05F 15/00; E05F 11/12

[52] U.S. Cl. ..... 49/218; 49/280; 49/360

[58] Field of Search ..... 49/363, 360, 218, 213, 49/214, 225, 449, 280, 279

[56] References Cited

U.S. PATENT DOCUMENTS 3,204,999 9/1965 Schwenk ..... 49/213

FOREIGN PATENT DOCUMENTS 2322692 11/1974 Fed. Rep. of Germany ..... 49/218
2331843 1/1975 Fed. Rep. of Germany ..... 49/218

*Primary Examiner*—Philip C. Kannan
*Attorney, Agent, or Firm*—Koda and Androlia

[57] ABSTRACT

A door operating device for operating by means of a DC motor the slide door of a slide door unit including an opening formed in the exterior panel of an automobile, the door designed to be arranged flush with the exterior panel when closed, guide rails extended along the upper frame, the lower frame of the opening and the outside surface of the exterior panel, respectively, and guide rollers for guiding the door along the guide rails. A first turnable arm is supported rotatably on the floor of the automobile, a second turnable arm is supported rotatably on the free end of the first turnable arm and a driving wheel is supported rotatably on the free end of the second turnable arm. The output torque of the motor is distributed into a torque for rotating the driving wheel and a torque for rotating the first turnable arm. When the motor is actuated with the door closing the opening of the exterior panel of the body of the automobile, first the door is swayed outside of the exterior panel of the body due to the rotatory motion of the first turnable arm and then the door is driven to slide along the exterior panel of the body by the agency of the frictional engagement of the driving wheel with a guide member secured to the inside surface of the door.

6 Claims, 11 Drawing Figures

DOOR OPERATING DEVICE FOR A SLIDE DOOR UNIT

BACKGROUND OF THE INVENTION

1. Field of the Invention

The present invention relates generally to a door operating device for a slide door unit and more particularly to a door operating device for a slide door unit having a door designed to be slidable along a wall and to be received in an opening formed in the wall with the outside of the door practically flush with the outside surface of the wall, wherein the door sliding motion and the door receiving motion are operated by means of a single prime mover to attain automatic operation of the door.

2. Description of the Prior Art

Slide door operating systems are classified broadly into two categories. In a slide door operating system belonging to the first category such as employed in houses and the rolling stock, a slide door is made to slide along a guide rail extending in a simple direction along the wall or the outside surface of the body of the rolling stock. In a slide door operating system belonging to the second category such as employed in automobiles, particularly in van type automobiles, the door is placed in the closed position with the exterior panel thereof arranged flush with the exterior panel of the body of an automobile, while the door is opened first by swinging the door outside of the exterior panel of the body and then by sliding the door along the outside surface of the exterior panel of the body.

In a slide door unit belonging to the second category, a first guide rail and a second guide rail are attached to the top portion and the bottom portion, respectively, of an opening formed in the body of an automobile, a third guide rail is attached to the exterior panel of the body, along which the door slides, at a position corresponding to the middle portion between the top portion and the bottom portion of the opening, the respective ends of the guide rails in one or the first direction of the sliding motion of the door are bent in a circular arc curved inwardly of the body of the automobile, a guide means attached to one side of the door in the other or the second direction of the sliding motion of the door is designed so as to slide along the third guide rail, guide means attached to the other side of the door in the first direction of the sliding motion of the door are designed to be slidable along the first and the second guide rails and those guide means are connected pivotally, if necessary, to the door so that the door is placed with the exterior panel thereof arranged practically flush with the exterior panel of the body when the opening of the body of the automobile is closed by the door and the door is swayed to move the exterior panel thereof outside of the exterior panel of the body in the initial stage of opening of the door and then the door is made to slide along the exterior panel of the body to the second direction of the sliding motion.

In order to attain automatic operation of such a slide door of the second category by means of prime movers such as DC motors, the door swaying motion to the outside of the exterior panel of the body and the door sliding motion along the exterior panel of the body are required to be performed simultaneously or individually. If those motions are to be powered by individual prime movers, at least two prime movers are needed and the relative timing of said door swaying motion and said door sliding motion has to be adjusted appropriately.

Furthermore, in order to attain the automatic operation of the slide door of a vehicle belonging to the second category by means of prime movers, the unlocking device of a door locking device provided for the door has to be operated to unlock the door locking device prior to said door swaying motion.

SUMMARY OF THE INVENTION

A primary object of the present invention is to provide a door operating device for placing a slide door in an opening formed in a wall with the outside surface of the slide door arranged practically flush with the outside surface of the wall and making sliding the door on at least a guide rail extending along the wall, including a single prime mover and capable of performing individual operations or a composite operation of making the slide door slide in parallel to the outside surface of the wall and raising the slide door in a direction perpendicular to the outside surface of the wall irrespective of the size of the curvature of the guide rail as well as of the type of the guide means for making the slide door along the guide rail.

Another object of the present invention is to provide a door operating device including a guide member secured to the door, an integrated turnable arm pivoted to a stationary portion with respect to the wall, a driving wheel and a roller which are disposed rotatably and in parallel to each other at the free end of the turnable arm so as to receive the guide member therebetween and a prime mover for rotating the driving wheel, wherein the driving torque of the prime mover is divided into a torque for driving the driving wheel and a torque for revolving the turnable arm and the slide door is made to slide along a curved guide rail extending along the wall.

A further object of the present invention is to provide a slide door operating device capable of unlocking a door locking device provided for the door, in the initial stage of the door opening operation, in which the door starts opening said opening formed in the wall from the state where the door is closing said opening and being received in said opening, by utilizing the respective movements of the turnable arm and the driving wheel.

According to the present invention, there is provided a slide door operating device for a slide door unit including a wall having an opening formed therein, a door for closing said opening, at least one guide rail attached to the wall so as to extend along the door opening direction and a guide means attached to the door and adapted to be slidable along the guide rail and the slide door unit being designed so that the door is received in the opening to close said opening with the outside surface of the door arranged practically flush with the outside surface of the wall and the door is enabled to slide practically in parallel to and along the outside surface of the wall by the guide means when the door is opened, the slide door operating device comprising a guide member being attached to the inside surface of the door and having a plate-shaped flange formed in parallel to the sliding direction of the door, a first turnable arm supported at the base portion thereof on a stationary portion with respect to the wall so as to be turnable practically in a horizontal plane, a driving pulley rotatably supported on the base portion of the first turnable arm, a second turnable arm supported on the free end of the first turnable arm with a first shaft so as to be turnable practically in a horizontal plane, an intermediate pulley rotatably supported on the first shaft, a third turnable arm supported on the free end of the second turnable arm with a second shaft so as to be turnable practically in a horizontal plane, a driven pulley rotatably supported on the second shaft, a driving wheel fixed to the driven pulley so as to rotate together with the driven pulley, a roller supported rotatably on the free end of the third turnable arm beside the driving wheel so as to closely receive the engaging flange of the guide member fixed to the door between the respective outer circumferences of the driving wheel and the roller a first means for rotatably interconnecting a prime mover to the driving pulley and a second means for rotatably interconnecting the driving pulley to the driven pulley through the intermediate pulley.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
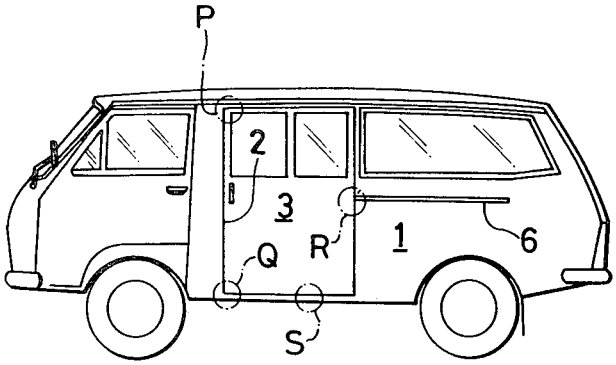
FIG. 1 is a side elevation of an automobile provided with a slide door unit suitable for carrying out the embodiments of the present invention.
Figure 2:
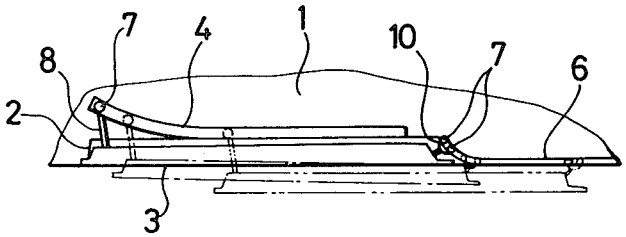
FIG. 2 is a schematic illustration of the slide door unit of FIG. 1 explaining the sliding motion of the slide door along the guide rails.

Referring to FIGS. 1 and 2, usually, a door 3 for closing an opening 2 formed in the side of the body 1 of an automobile for passengers' getting on and off the automobile or for loading and unloading the automobile is placed at the closed position with outside surface of the exterior panel arranged flush with the outside surface of the exterior panel of the body 1. The door 3 is opened first by swaying the door outside of the exterior panel of the body 1 and then by sliding the door in parallel to the outside surface of the exterior panel of the body 1 toward the rearward of the automobile. In order to carry out such a door opening and closing operation, a first guide rail 4, a second guide rail 5 (FIG. 4) and a third guide rail 6 are attached to the body 1 of the automobile. The first guide rail 4 and the second guide rail 5 are provided along the respective edges of the top portion and the bottom portion, respectively, of the opening 2 and the third guide rail 6 is provided on the outside surface of the exterior panel of the body 1 at a position corresponding to the middle portion between the top and the bottom portions of the opening 2 so as to extend from the rear side of the opening 2 toward the rearward of the body 1 (the designation of directions such as "forward" and "rearward" and of the part of the automobile such as "the front" and the "rear" will be used with respect to the forward running direction of the automobile hereinafter). The respective forward ends of the guide rails 4, 5 and 6 are curved inwardly of the body 1. Guide means 8, 9 and 10 each supporting one or a plurality of rollers 7 engaging with the corresponding guide rail 4, 5 or 6 are provided on the inside surface of the door 3 at a front top position P, a front bottom position Q and a rear middle position of the rear side of the door respectively. The door 3 is made to slide along the guide rails 4, 5 and 6 by the agency of the guide means 8, 9 and 10. The disposition of the first and the second guide rails 4 and 5 with respect to the opening 2 is practically symmetrical and the shapes of the curvature thereof are practically the same. Usually the weight of the door 3 is received by the body 1 through the second guide rail 5 and the third guide rail 6.

Figure 3:
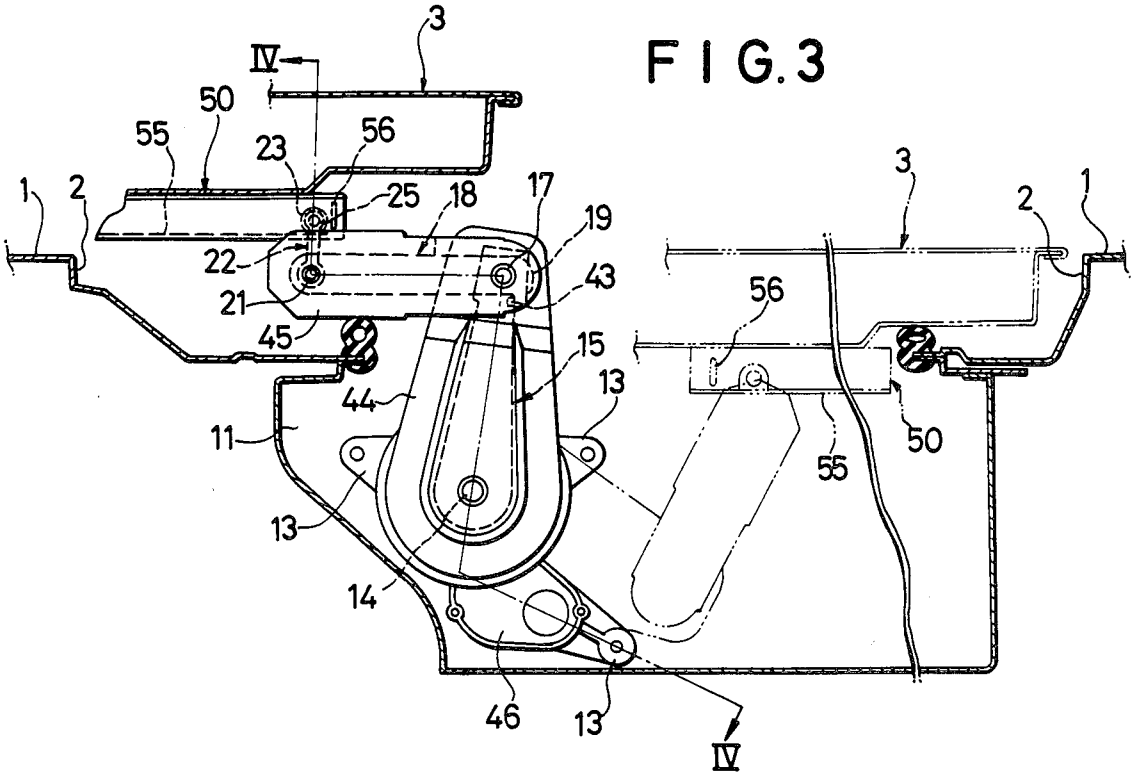
FIG. 3 is a plan view of one embodiment of a slide door operating device according to the present invention.
Figure 4:
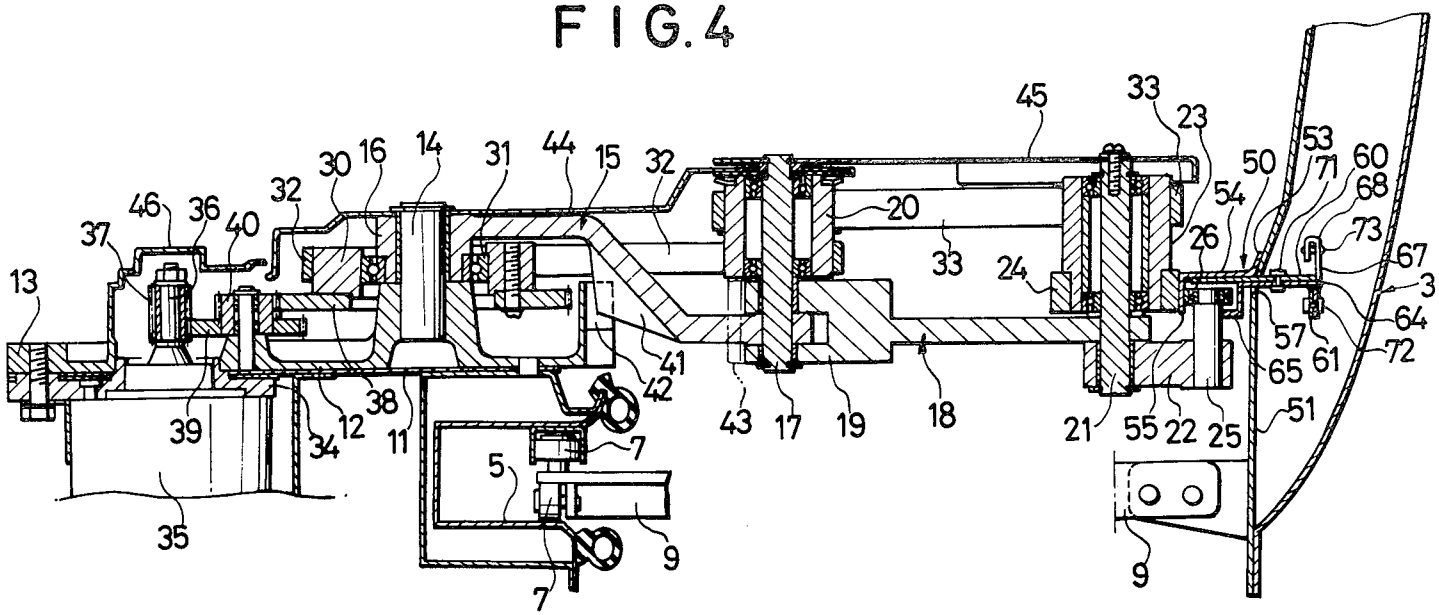
FIG. 4 is a sectional view taken along line IV—IV of FIG. 3.

FIG. 3 is a plan view of a preferred embodiment of a slide door operating device according to the present invention and FIG. 4 is a sectional view taken along line IV—IV of FIG. 3. Referring to FIGS. 3 and 4, a box-shaped stationary member 12 having the open top is fixed at the attaching portions 13 thereof to a base floor 11 facing the rear bottom position S of the opening 2 of the body 1 (FIG. 1). A base shaft 14 is fixedly fitted in a tubular column formed practically in the central portion of the stationary member 12. A turnable arm 15 is supported at the base portion 16 thereof on the base shaft 14 through a bearing so as to be turnable on the base shaft 14 within a plane extending in parallel to the base floor 11. A first shaft 17 is fixedly fitted in the free end of the first turnable arm 15. A second turnable arm 18 is supported at the bifurcate base portion 19 thereof on the first shaft 17 through a bearing so as to be turnable on the first shaft 17 within a plane extending in parallel to the base floor 11. An intermediate pulley 20 is supported rotatably on the first shaft 17 through a bearing. A second shaft 21 is fixedly fitted in the free end of the second turnable arm 18. A third turnable arm 22 is supported at the base portion thereof on the second shaft 21 so as to be turnable within a plane extending in parallel to the base floor 11. A driven pulley 23 is supported rotatably on the second shaft 21 through a bearing. A driving wheel 24 which is formed in a shape of a ring and made of highly frictional material such as rubber or a synthetic rubber, is attached to the outer circumference of the driven pulley 23 at one axial end portion thereof concentrically with the driven pulley 23 so that the driving wheel 24 will be rotated together with the driven pulley 23. A short shaft 25 is fixed to the free end of the third turnable arm 22 in parallel to the second shaft 21. A roller 26 is supported rotatably on the short shaft 25 so as to be disposed with the outer circumference thereof positioned opposite to the outer circumference of the driving wheel 24 with a small gap therebetween.

The base portion 16 of the first turnable arm 15 is formed in a cylindrical shape. An annular driving pulley 30 is supported on the base portion 16 through a bearing 31 so as to be rotatable within a plane including the intermediate pulley 20. A first endless belt 32 is extended between the driving pulley 30 and the intermediate pulley 20 to interconnect those pulleys rotatively. A second endless belt 33 is extended between the axially upper portion of the intermediate pulley 20 and the driven pulley 23 to interconnect the intermediate pulley 20 and the driven pulley 23 rotatively.

A DC motor 35 is mounted fixedly to one end of the stationary member 12 within an opening formed on the bottom of the stationary member through a sub stationary member 34 so that the output shaft 36 of the DC motor protrude into the stationary member 12 in parallel to the base shaft 14. An output pinion 37 is fixed to the output shaft 36 of the DC motor 35, while an input gear wheel 38 is fixed integrally and concentrically to the driving pulley 30. The output pinion 37 and the input gear wheel 38 are engaged directly or rotatively interconnected through intermediate gears 39 and 40. Thus the output shaft 36 of the DC motor 35 and the driving pulley 30 are rotatively interconnected through a reduction gear train. The position of the first turnable arm 15 shown by solid lines in FIG. 3 is the final position of the first turnable arm 15 in the counterclockwise rotation of the first turnable arm 15 from a door closing position as shown by chain lines with two short dashes. A projection 41 serving also as a reinforcing rib is formed in the underside of the first turnable arm 15 and a stopper 42 is protruded from one side of the stationary member 12 at a predetermined position (FIG. 4) to restrict the further counterclockwise rotation of the first turnable arm 15 from the position shown by solid lines in FIG. 3. A stopper 43 fixed to the bifurate base portion 19 of the second turnable arm 18 in parallel to the first shaft 17 comes into abutment with the first turnable arm 15 to restrict the rotation of a line connecting the first shaft 17 and the second shaft 21 on the second turnable arm 18 with respect to a line connecting the base shaft 14 and the first shaft 17 on the first turnable arm 15 through an angle exceeding a predetermined angle.

As shown clearly in FIGS. 3 and 4, a guide member 50 is fixed to the door 3 along the front-rear direction of the body 1. The guide member 50 is a longitudinally straight member formed by bending an elongate plate in its cross section to form an attaching flange 53 to be placed contiguously to and fixed with fasteners 52 to the interior panel 51 of the door 3, a supporting flange 54 formed by bending the extension of the attaching flange 53 and an engaging flange 55 formed by bending the extension of the supporting flange 54 practically at a right angle so as depend from the supporting flange 54. The guide member 50 is fixed at the attaching flange 53 to the interior panel 51 of the door 3. The engaging flange 55 depending from the supporting flange 54 at a distance corresponding to the width of the supporting flange 54 from the interior panel 51 is received between the driving wheel 24 and the roller 26. The size of a gap between the outer circumference of the driving wheel 24 and the outer circumference of the roller 26 is the same as or smaller than the thickness of the engaging flange 55 to secure firm frictional contact between the engaging flange 55 and the driving wheel 24. The width of the supporting flange 54 is determined so as to ensure smooth movement of the roller 26 within a space formed between the interior panel 51 of the door 3 and the engaging flange 55. A stopper 56 formed by bending a plate is fixed to the guide member 50 at each longitudinal end of the engaging flange 55 thereof to prevent the roller 26 from running off the engaging flange 55.

In the drawing, a cover for covering the first turnable arm 15 is indicated at 44, a cover for covering the second turnable arm 18 at 45 and a cover for covering a section for disposing the DC motor 35 at 46.

Figure 6:
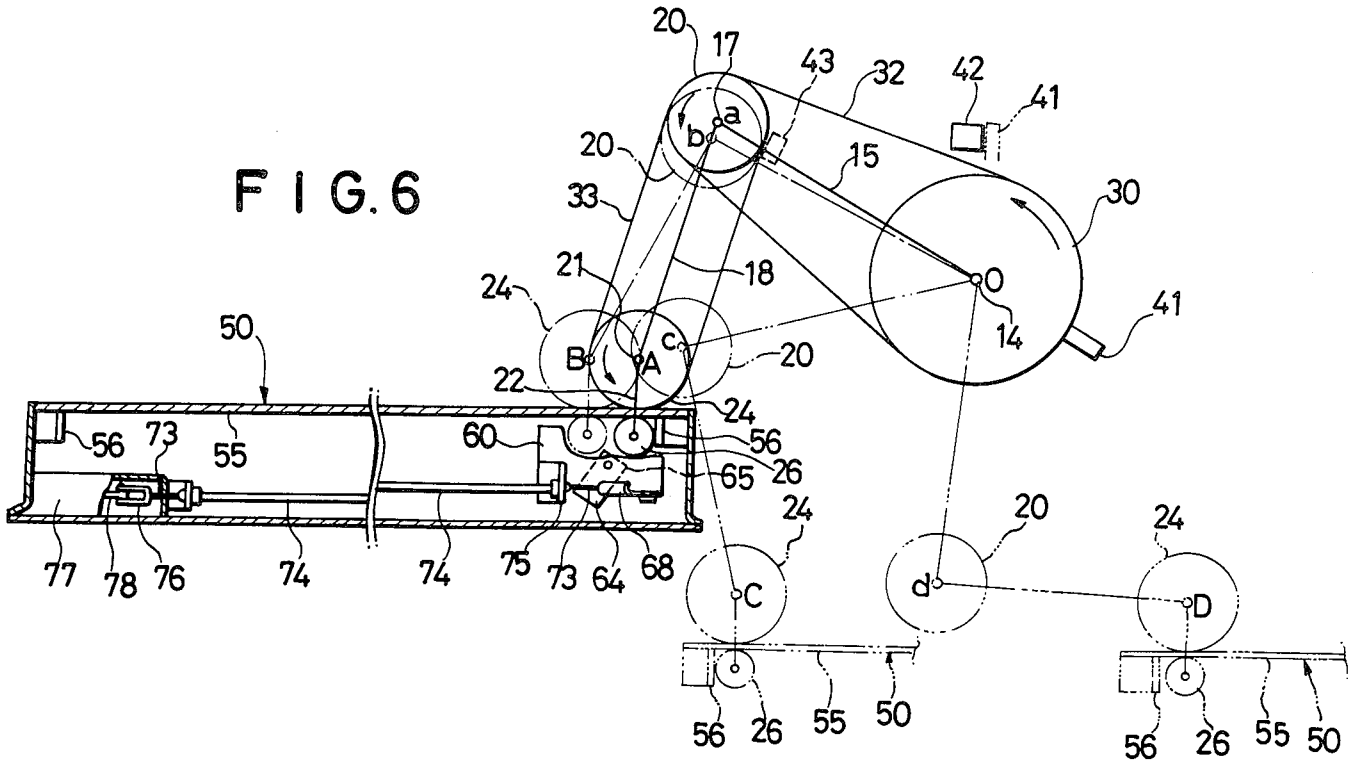
FIG. 6 is a diagrammatic representation illustrating the manner of operation of the embodiment of FIG. 3.

The manner of operation of the embodiment of the present invention as described hereinbefore will be explained hereunder with reference to FIG. 6. FIG. 6 is a diagrammatic representation of the embodiment representing the driving pulley 30, the intermediaate pulley 20, the driving wheel 24 and the roller 26 by circles of diameters proportional to the respective diameters thereof, the base shaft 14, the first shaft 17, the second shaft 21 and the short shaft 25 are represented by small circles indicating the centers of those circles and the turnable arms 15, 18 and 22 are represented by lines connecting the respective centers of those circles. The respective positions of the projection 41 of the first turnable arm 15, the stopper 42 to be brought into abutment with the projection 41 and the stopper 43 fixed to the second turnable arm 18 are shown to indicate the functions thereof irrespective of the corresponding positions as shown in FIGS. 3 and 4, in order to facilitate the understanding of the constitution and the manner of operation.

When the door 3 is closing the opening 2 and is received in the opening with the exterior panel thereof arranged flush with the exterior panel of the body 1, the guide member 50 fixed to the door 3 is located at a position illustrated by solid lines and the engaging flange 55 is received between the driving wheel 24 and the roller 26. When a DC current of one direction is supplied to the DC motor 35, the output shaft 36 of the motor 35 rotates the driving pulley 30 through the reduction gear train in the direction of the arrow. The torque of the motor 35 driving the driving pulley 30 is transmitted to the intermediate pulley 20 through the belt 32 and further to the driving pulley 23, hence to the driving wheel 24, through the belt 33.

When the door 3 is located at the closed position, the rollers 7 of the guide means 8, 9 and 10 are located in the respective sharply curved portions of the guide rails 4, 5 and 6 respectively as shown in FIG. 2. Therefore, the rotation of the driving wheel 24 in the direction of the arrow for the effort of causing the guide member 50 to move in the longitudinal direction encounters a large resistance resulting from the frictional engagement between the driving wheel 24 and the engaging flange 55 of the guide member 50. The resistance applied to the driving wheel 24 is transmitted to the driving pulley 30 through the belts 33 and 32, so that the torque of the motor 35 transmitted to the driving pulley 30 is distributed through the belt 32 to turn or revolve the first turnable arm 15 in a counterclockwise direction direction so that the center of the intermediate pulley 20 is caused to move to a point b, while the center of the driving wheel 24 is caused to move to a point B. At the same time, the stopper 43 fixed to the second turnable arm 18 is brought into abutment against the first turnable arm 15. Consequently, the angle between the turnable arms 15 and 18 can not exceed an angle ObB. Upon the abutment of the stopper 43 against the first turnable arm 15, a counterclockwise revolving force about the center O of the driving pulley 30, namely a force to move the guide member 50 outward of the body 1, is applied to the guide member 50 in addition to a thrust force along the longitudinal direction of the engaging flange 55 applied by the driving wheel 24. The resultant force of the thrust force and the counterclockwise revolving force causes the rollers 7 of the guide means 8, 9 and 10 to slide along the respective curved portions of the guide rails 4, 5 and 6 respectively, so that the door 3 is swayed outward of the exterior panel of the body 1. The counterclockwise rotation of the first turnable arm 15 continues while the resistance of the curved portions of the guide rails 4, 5 and 6 is effective, so that the door 3 is moved along the curved portions of the guide rails 4, 5 and 6 by the resultant force of the swaying force of the first turnable arm 15 and the thrust force of the driving wheel 24. When the center of the driving wheel 24 arrives at a point C, the rollers 7 of the guide means 8, 9 and 10 come off the curved portions of the guide rails 4, 5 and 6, then all the driving torque of the motor 35 is used exclusively for driving the driving wheel 24, so that the guide member 50 illustrated by chain lines with two short dashes causes the door 3 to move along the exterior panel of the body 1 as far as the roller 26 is brought into abutment against the stopper 56. When the roller 26 is brought into abutment against the stopper 56 with the center of the driving wheel 24 located at the point C, the rotation of the driving wheel 24 encounters a resistance again, so that the first turnable arm 15 is turned again in a counterclockwise direction until the projection 41 formed in the first turnable arm 15 is brought into abutment against the stopper 42. By this time, the center of the driving wheel 24 arrives at a point D and the door 3 is opened to a position corresponding to the position of the guide member 50 as shown by chain lines with three short dashes. By this time, the first turnable arm 15 and the second turnable arm 18 have moved to positions illustrated by chain lines with three short dashes Od and dD respectively. The door opening operation is interrupted by interrupting power supply to the motor 35 to stop the motor 35 with an optional means, such as a limit switch which is adapted to be actuated upon or immediately before the abutment of the projection 41 against the stopper 42.

With the purpose of closing the door 3, a DC voltage of a polarity opposite the polarity of the DC voltage applied in opening the door 3 is applied to the motor 35 to rotate the driving pulley 30 in a direction reverse to the direction of the arrow in FIG. 6. Since the least resistance is offered to the effort of the driving wheel 24 to advance the door 3 while the center of the driving wheel 24 is located at the point D in the initial stage of door closing operation, the driving wheel 24 frictionally drives the engaging flange 55 of the guide member 50 with the center thereof remaining at the point D to cause the door 3 to slide along the guide rails in the closing direction. After the door 3 has been made to slide to a position where the stopper 56 fixed to the other end of the guide member 50 is brought into abutment against the roller 26, a resistance is offered to the driving effort of the driving wheel 24 and hence the first turnable arm 15 is rotated by the driving torque of the motor 35 in a clockwise direction in FIG. 6 to move the door 3 in the closing direction. After the center of the driving wheel 24 has reached the point C, the clockwise rotation of the first turnable arm 15 retracts the door 3 toward the opening 2 formed in the exterior panel of the body 1. The point c of the center of the intermediate pulley 20 when the center of the driving wheel 24 is located at the point C returns to the point a through the point b as the first turnable arm 15 rotates in a clockwise direction, while the center of the driving wheel 24 returns directly from the point C to the point A, so that the door 3 is received in the opening 2 with the outside surface arranged flush with the outside surface of the body 1. At this moment, a limit switch or the like is actuated to interrupt power supply to the motor 35 and the door is locked to complete the door closing operation.

As is well understood from the illustration of FIG. 6 and the explanation made hereinbefore with reference thereto, the driving wheel 24 moves in a direction reverse to the door opening direction from the position corresponding to the point A to the position corresponding to the point B, in the initial stage of the door opening operation for opening the door 3 from the closed position. As shown in FIGS. 4 and 6 and as shown in enlarged views in FIGS. 7 and 8, a plate-shaped supporting member 60 is placed contiguously to and fixed to the supporting flange 54 of the guide member 50, the main part of the supporting member 60 is inserted through an opening 57 formed in the interior panel 51 of the door 3 so as to protrude into the cavity of the door 3 and the end portion of the main part of the supporting member 60 is bent downward practically in a right angle in the cavity to form a depending flange 61. A plate-shaped rocking member 64 is supported pivotally on the underside of the supporting member 60 with a shaft 71. One end of the rocking member 64 is bent down so as to depend in parallel to the shaft 25 and the free end of the depending portion is bent horizontally to form a horizontal portion. The extremity of the horizontal portion is cut diagonally to form a strike head 65 having a diagonal edge 65' protruding into the path of the short shaft 25. The other end of the rocking member 64 is extended outside of the depending flange 61 of the supporting member 60 through an opening 63 formed in the depending flange 61 and an engaging portion 66 is formed in the protruding portion thereof.

A plate-shaped operating lever 67 is supported pivotally at the lower end thereof with a shaft 72 on the lower end of the depending flange 61 of the supporting member 60. The upper end of the operating lever 67 extends above the supporting member 60 and is bent in a U-shaped to form a fastening portion 68. One end of the inner wire 73 of a flexible cable is fastened to the fastening portion 68. A spring 80 is extended between the rocking member 64 and a tongue 62 formed by raising a part of the supporting member 60 to press the engaging portion 66 of the rocking member 64 lightly against one side edge of the operating lever 67.

One end of the other lace 74 of the flexible cable is fastened to a fixed member 75 fixed on the upper side of the supporting member 60. The other end of the inner wire 73 of the flexible cable is connected through a connector 76 to the free end of the unlocking lever 78 of a door locking device 77 attached to the indide surface of the door 3. The other end of the outer lace 74 of the flexible cable is fastened to a supporting member 79 provided for the door locking device 77 or the door 3.

The door locking device 77 locks the door 3 to the body of the automobile after the door 3 has closed the opening 2 completely to prevent the accidental opening of the door 3. Usually, such a door locking device comprises a stationary member provided on a column of the body of the automobile and a rotatable catch, a locking mechanism to restrain the rotaion of the catch and the unlocking lever 78 for cancelling the restraint of the locking mechanism upon the catch which are provided on the door 3. The resilient force of a spring included in the locking mechanism or a spring provided individually for the unlocking lever 78 acts on the unlocking lever 78. The restraint of the locking mechanism upon the catch is cancelled by pulling or turning the unlocking lever 78 against the resilient force of the spring. The present invention is applicable as it stands to ordinary door locking devices.

Figure 7:
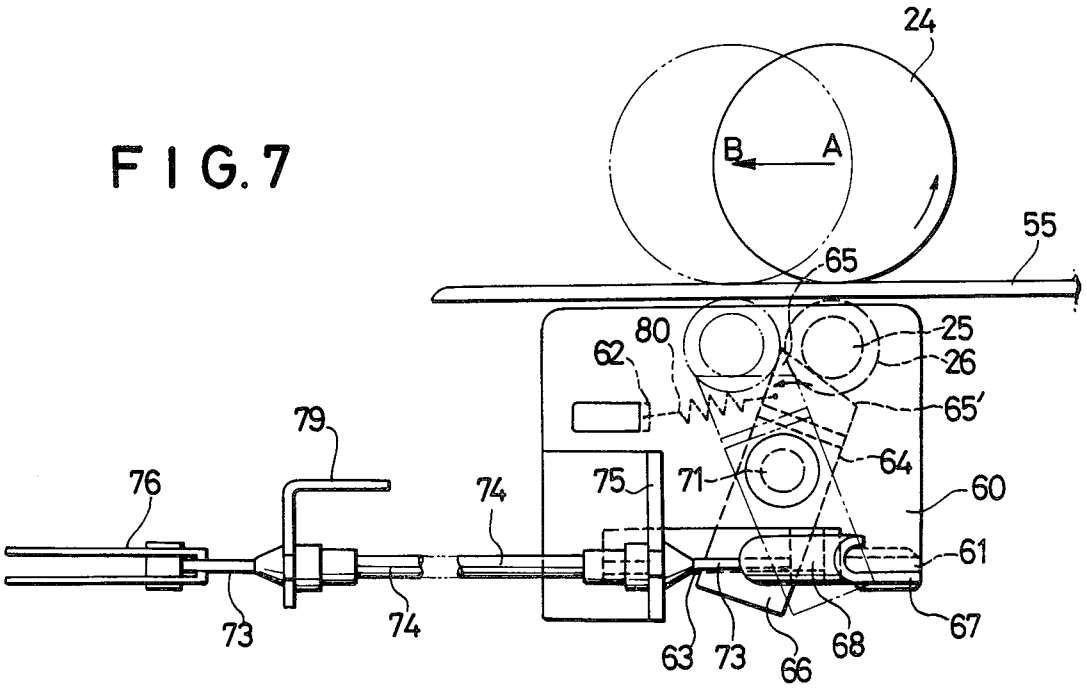
FIG. 7 is a plan view of an operating device interlocked with the locking device of the embodiment of FIG. 3.
Figure 8:
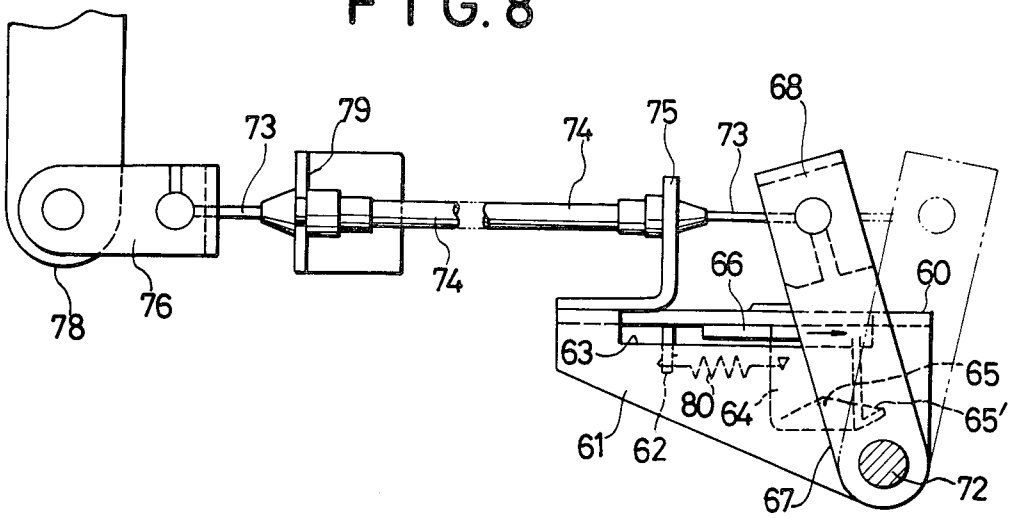
FIG. 8 is a side elevation of the operating device of FIG. 7.

In order to open the door 3 which is closing the opening 2 perfectly, it occures the necessity to unlock the door locking device locking the door 3 to the body for making the door to be ready to move. Referring to FIGS. 6 and 7, in the slide door operating device of the present invention, the door 3 is not moved while the center of the driving wheel 24 located at the point A corresponding to one end of the guide member 50 is moved to the point B in the initial stage of the door opening operation after a DC current of a polarity for rotating the motor 35 in the door opening direction is supplied to the motor 35 to rotate the first turnable arm 15 and the door is swayed outside of the exterior panel of the body 1 after the center of the driving wheel 24 has reached the point B. The door locking device is unlocked within a period while the center of the driving wheel 24 is moved from the point A to the point B.

After the first turnable arm 15 has been actuated to rotate in the initial stage of the door opening operation, the roller 26 and the short shaft 25 are moved together in the same direction and for the same distance along the engaging flange 55 of the guide member 50 as the center of the driving wheel 24 is moved from the point A to the point B. As the strike head 65 formed at one end of the rocking member 64 is protruded into the path of the roller 26 within the range of movement of the roller 26, therefore, the short shaft 25 runs against the strike head 65 to turn the rocking member 64 in a counterclockwise direction as shown by the arrow in FIG. 7 on the shaft 71. When the rocking member 64 is thus turned, the engaging portion 66 formed at the other end of the rocking member 64 collides against one side edge of the operating lever 67 to turn the operating lever 67 on the shaft 72 in a clockwise direction as shown by the arrow in FIG. 8 as far as a position illustrated by chain lines with two short dashes (FIGS. 7 and 8), so that the inner wire 73 of the flexible cable fastened to the fastening portion 68 formed at the free end of the operating lever 67 is pulled and thereby the unlocking lever 78 of the locking device 77 is pulled to unlock the locking device 77.

As the first turnable arm 15 is rotated further, the door 3 starts to be swayed outside of the exterior panel of the body 1. As the door 3 is swayed outside, the rollers 7 of the guide means 8, 9 and 10 move along the guide rails 4, 5 and 6 and finally come off the respective curved portions of the guide rails 4, 5 and 6. Then, the resistance which has been offered to the driving wheel 24 is reduced suddenly, so that the driving wheel 24 is allowed to rotate to drive the guide member 50, whereby the door 3 is opened. As the driving wheel 24 rotates, there occurs the relative displacement of the driving wheel 24 to the other end of the engaging flange 55 of the guide member 50. When the center of the driving wheel 24 is located at the position B, the short shaft 25 is in collision against the diagonal edge 65' of the strike head 65 turning the rocking member 64 through the maximum angle of turning. As the driving wheel 24 moves along the engaging flange 55, the short shaft 25 moves away from the diagonal edge 65' of the strike head 65, so that the rocking member 64 is moved back to the original position by the resilient force of the spring 80. Consequently, the unlocking lever 78 is returned to its original position by the resilient force of the spring working on the unlocking lever 78, because the force pulling the unlocking lever 78 is cancelled. The returning motion of the unlocking lever 78 returns the operating lever 67 to its original position through the inner wire 73 of the flexible cable.

The strike head 65 of the rocking member 64 is brought into collision against the short shaft 25 before the center of the driving wheel 24 arrives at the point B. Upon the arrival of the center of the driving wheel 24 at the point B, the short shaft 25 is brought into abutment against the diagonal edge 65'. Thus, when the center of the driving wheel 24 arrives at the point B, the rocking member 64 is turned through the maximum angle of turning to unlock the door locking device 77 completely. The door locking device 77 remains unlocked while the door 3 is swayed outward by the revolving motion of the first turnable arm 15. The short shaft 25 moves away from the diagonal edge 65' of the strike head 65 after the door 3 has fully been swayed outward and the resistance which has been offered to the driving wheel 24 is reduced to allow the driving wheel 24 to start rotating.

In the door closing operation, the rocking member 64 is turned in a clockwise direction opposite the direction of the arrow as shown in FIG. 7 by the short shaft 25 while the center of the driving wheel 24 moves from the position C to the position A in closing the door 3. However, since the rocking member 64 moves away from the operating lever 67 against the resilient force of the spring 80 as the rocking member 64 turns in a clockwise direction, the rocking member 64 is allowed to turn freely and is returned to a position where the rocking member 64 rests on the operating lever 67, after the short shaft 25 has passed by the rocking member 64.

Figure 10:
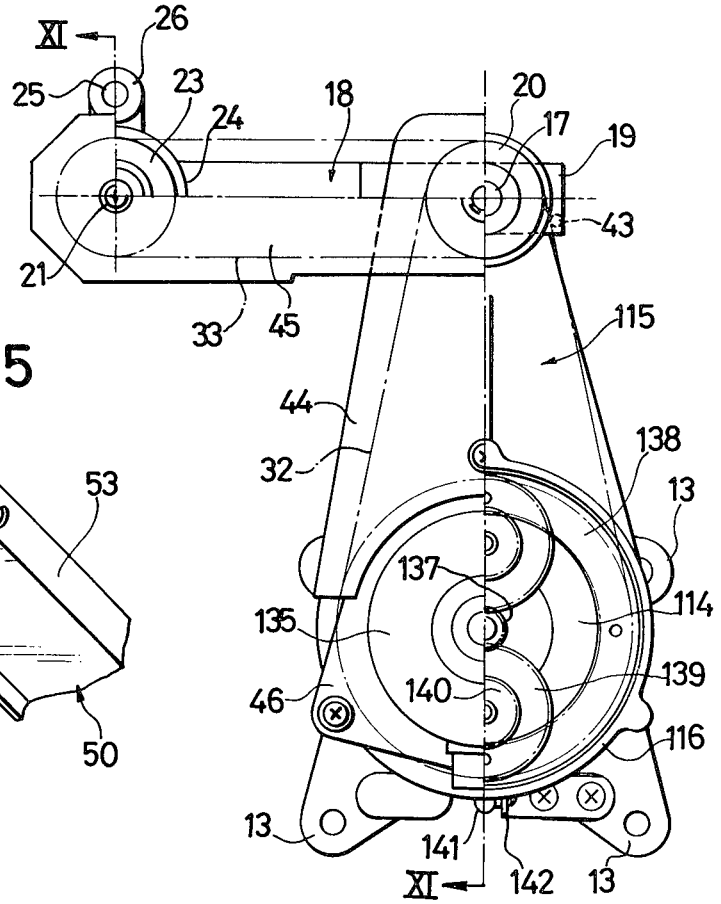
FIG. 10 is a partly cutaway enlarged plan view of the essential part of the slide door operating device of FIG. 9.
Figure 9:
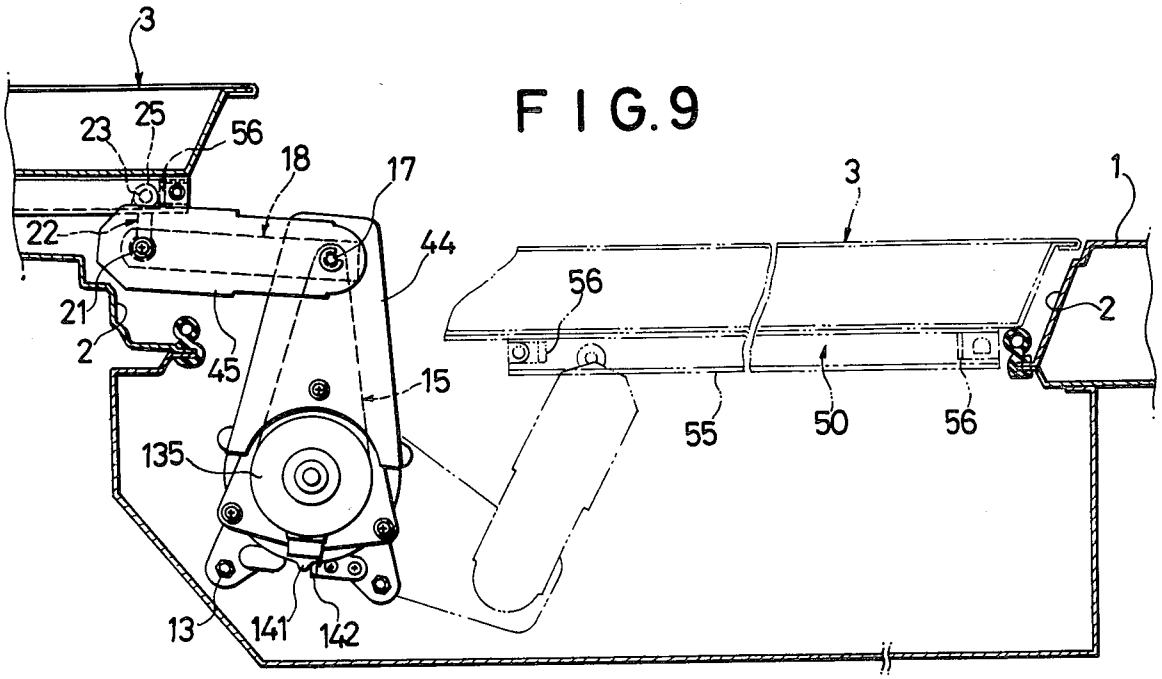
FIG. 9 is a plan view of another embodiment of a slide door operating device according to the present invention.
Figure 11:
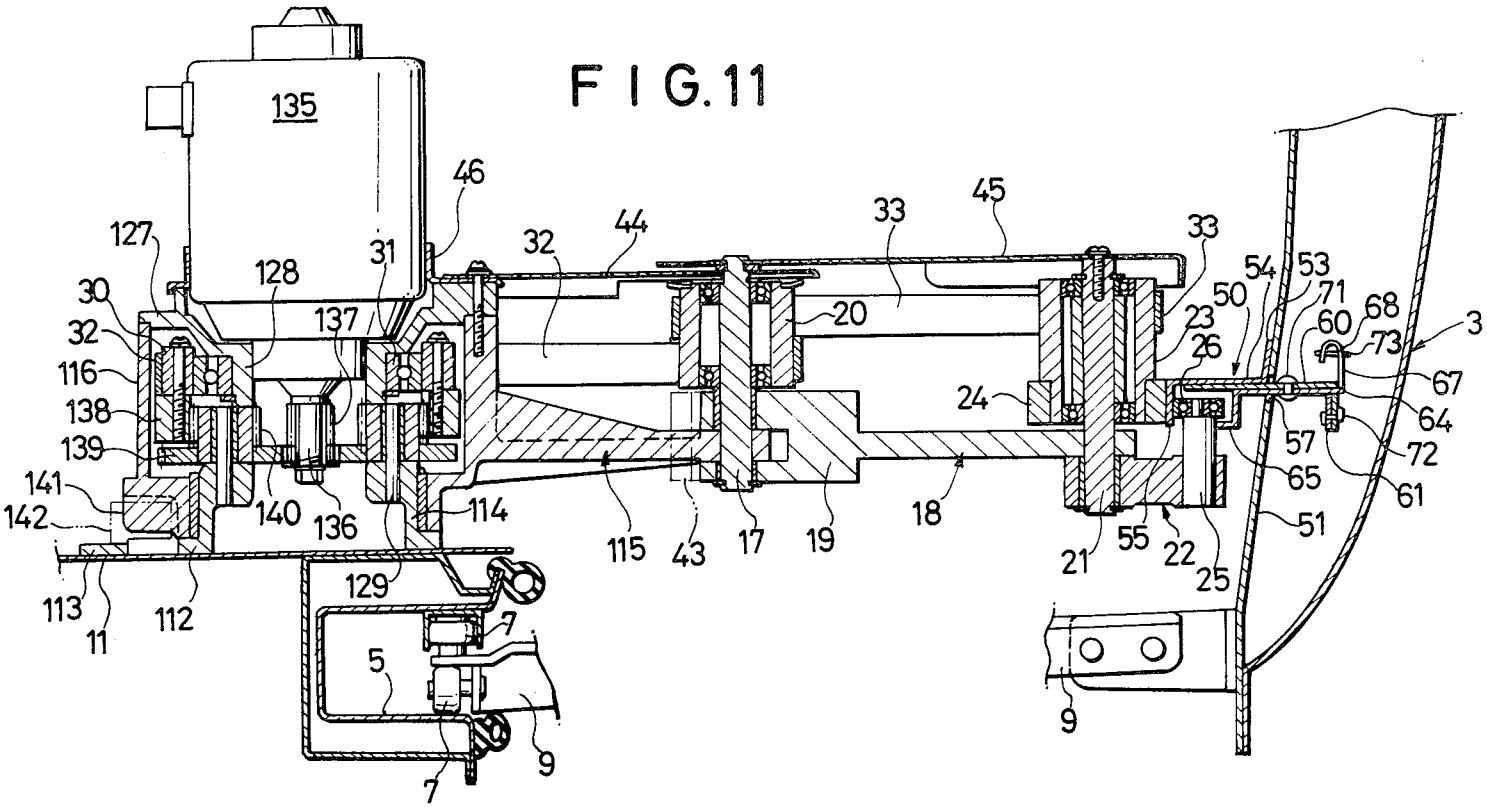
FIG. 11 is a sectional view taken along line XI—XI of FIG. 10.

Another embodiment of the present invention is shown in FIGS. 9 to 11, wherein FIG. 9 is a plan view and FIG. 11 is a sectional view taken along line XI—XI of FIG. 10. FIG. 10 is an enlarged plan view of the essential part of the device with part of the cover on one side of line XI—XI removed to show the interior mechanism.

Figure 5:
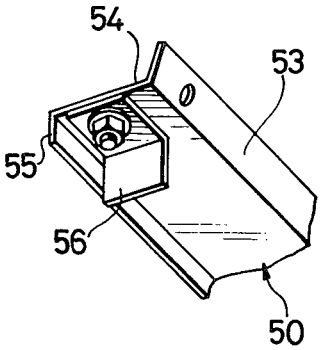
FIG. 5 is an enlarged perspective view of part of FIG. 4.

This second embodiment differs, as most clearly be seen from FIG. 11, from the first embodiment as shown in FIGS. 3 to 5 in that a DC motor 135 is mounted on and secured to the base portion 116 of a first turnable arm 115 and the output shaft 136 of the motor 135 is connected rotatively to a driving pulley 30 through a planetary reduction gear. Accordingly, like parts are designated by like reference characters and the explanation thereof will be omitted.

A cylindrical base 114 is formed in a stationary member 112 placed on a base floor 11 and fastened thereto with an attaching portions 113. The first turnable arm 115 is supported rotatably at the base portion 116 thereof on the cylindrical base 114 through a bearing fitted to the lower end of the base portion 116. The base portion 116 of the first turnable arm 115 is formed in the shape of a hollow cylinder. A supporting member 127 is fixed to the top of the base portion 116 to receive the motor 135 thereon. The motor 135 is located so that the output shaft 136 is aligned with the center axis of the base portion 116 of the first turnable arm 115. The driving pulley 30 is supported rotatably on a cylindrical wall 128 formed in the supporting member 127 about the center axis of the base portion 116 through a bearing A ring gear 138 is fixedly and concentrically mounted on the driving pulley 30, a sun gear 137 is fixed to the output shaft 136 of the motor 135 concentrically with the output shaft 136 and composite planetary pinions each comprising a pinion 139 engaging with the sun gear 137 and a pinion 147 engaging with the ring gear 138 are supported rotatably on pins 129 fixed to the cylindrical base 114 to constitute a planetary reduction gear. A stopper 142 is fixed to the attaching portion 113 of the fixed member 112 to restrict the further rotation of the first turnable arm 115 after the door 3 has fully been opened. The protrusion 141 corresponding to the stopper 142 is formed in the outer circumference of the lower end of the base portion 116 of the first turnable arm 115.

In this second embodiment, when a DC current of a polarity is supplied to the motor 135, the output shaft 136 drives sequentially the sun gear 137, the composite planetary pinions each comprising the pinions 139 and 140 and the ring gear 138. Since the pinions 139 and 140 rotate around on the common axis on the pin 129, the rotation of the output shaft 136 is transmitted to the ring gear 138 at a reduced rate and thereby the driving pulley 30 combined with the ring gear 138 in a unity is rotated. The rotation of the driving pulley 30 is transmitted to a driving wheel 24 through the belt 32, the intermediate pulley 20, the belt 33 and the driven pulley 23. Then, the driving wheel 24 drives the door 3 through the frictional engagement with the engaging flange 55 of the guide member 50 in the same manner as the first embodiment.

In the operation of the second embodiment, when the door 3 moves along the respective curved portions of guide rails 4, 5 and 6, a resistance is offered to the rotation of the driving wheel 24 and the ring gear 138, hence the reaction of the driving torque of the motor 135 causes the first turnable arm 115 to rotate through the supporting member 127, because braking force is applied to the ring gear 138 of the planetary gear mechanism. Accordingly, the first turnable arm 115 sways the door 3 outside or inside of the body. Consequently, the second embodiment of the present invention also is capable of operating the door to open and to close in the same manner as described with reference to FIG. 6.

In the second embodiment of the present invention, the rotation of the output shaft 136 of the motor 135 is transmitted to the driving pulley 30 after reducing the revolving rate thereof through the planetary reduction gear comprising the sun gear 137, the ring gear 138 and composite planetary pinions each comprising the pinions 139 and 140 and the driving torque of the motor 135 is distributed into a driving torque for driving the driving wheel 24 and a driving torque for rotating the first turnable arm 115 by means of the planetary reduction gear, therefore, a high torque is available for swaying out or for retracting the door 3.

In the second embodiment also, the supporting member 60 is placed contiguously to and fixed to the supporting flange 54 of the guide member 50 and the rocking member 64 and the operating lever 67 are pivotally joined to the supporting member 60 with shafts 71 and 72 respectively. The constructions of the rocking member 64 and the operating lever 67 are identical with those employed in the first embodiment and the manner of interlocking the operating lever 67 and the unlocking lever 78 of the door locking device also is identical with that employed in the first embodiment as described hereinbefore.

As described in detail hereinbefore, the present invention provides a door operating device for a slide door unit including a wall having an opening formed therein, a door for closing said opening, at least one guide rail attached along the wall so as to extend in the direction of opening the door and guide means attached to the door so as to be slidable along the guide rail, and capable of receiving the door with the outside surface of the door arranged flush with the outside surface of the wall when the door is closed and of guiding the door to slide along and practically in parallel to the outside surface of the wall. Said door operating device according to the present invention comprises a guide member having a plate-shaped engaging flange formed along the sliding direction of the door and attached to the inside surface of the door, a first turnable arm supported at the base portion thereof so as to be turnable within a practically horizontal plane on a stationary portion with respect to the wall, a driving pulley supported rotatably and coaxially on the base portion of the first turnable arm, a second turnable arm supported so as to be turnable practically within a horizontal plane on the first turnable arm at the free end thereof with a first shaft, an intermediate pulley supported rotatably on the first shaft, a third turnable arm supported so as to be turnable practically within a horizontal plane on the second turnable arm at the free end thereof with a second shaft, a driven pulley designed to rotate together with a driving wheel and supported rotatably on the second shaft and a roller supported rotatably on the third turnable arm at the free end thereof beside the driving wheel, wherein the engaging flange of the guide member fixed to the door is engaged with and received between the outer circumference of the driving wheel and the outer circumference of the roller, the driving pulley is connected rotatively to a prime mover, the driving pulley and the intermediate pulley are interconnected rotatively and the intermediate pulley and the driven pulley are interconnected rotatively.

According to the present invention, since the driving wheel, which is frictionally engaged with the engaging flange of the guide member fixed to the door and adapted to be rotated by means of the prime mover, is disposed on the free end of a second turnable arm pivotally supported at the base portion thereof on the first turnable arm at the free end thereof, an increased sliding distance of the door is provided as compared with a constitution in which the driving wheel is provided on the free end of the first turnable arm and furthermore, since the center of rotation of the first turnable arm can be placed at a position apart from the door by a length of the first turnable arm, the width of the opening formed in the body and the width of the door can be increased without disadvantageously requiring an increased space for housing the entire device.

Furthermore, since the rotatory driving operation of the driving wheel for moving the door in parallel to the wall and the rotatory operation of the first turnable arm for pushing out or retracting the door perpendicularly to the wall are carried out by means of a single prime over and a torque required for moving the door perpendicularly to the wall is distributed to the first turnable arm based on the magnitude of the resistance offered to the movement of the door due to the engagement of the guide means of the door with the curved portions of guide rails, the door can be moved extremely smoothly along the guide rails by means of a single prime mover.

Still further, a stopper is provided to restrain the angle between the first turnable arm and the second turnable arm from increasing over a predetermined angle, so that the driving force of the prime mover is used effectively for surely moving the door when the first turnable arm is driven in a turning direction for advancing the second turnable arm. And since the second turnable arm is drawn when the first turnable arm is driven in a turning direction reverse to the turning direction for advancing the second turnable arm, the stopper never obstruct the movement of the turnable arms and no loss of the driving force of the prime mover is caused.

Furthermore, when a stopper is provided to restrain the first turnable arm from rotating excessively at a position corresponding to the position of which the door is fully swayed outside of the wall, a sufficient sliding distance of the door is provided by the combined operation of the rotatory operation of the first turnable arm through the least necessary angle of rotation and the frictional driving operation of the driving wheel for moving the door.

Furthermore, by the specific constitution in accordance with the present invention, in which the driving wheel is disposed on the free end of the second turnable arm pivotally joined to the free end of the first turnable arm, the door locking device can be unlocked timely in the initial stage of the door opening operation for opening the door from the closed position where the door is closely received in the opening formed in the wall prior to the outward movement of the door, since the door remains stationary during the relative angular movement between the first and the second turnable arms through a predetermined angle in the initial stage of the door opening operation. A rocking member is supported pivotally for rocking motion along the direction of movement of the door on the guide member near the front end thereof so that one end of the rocking member protrude into the path of the roller, a strike head is formed at the free end of the said end of the rocking member, the other end of the rocking member is connected to the unlocking device of a door locking device provided for the door by suitable means and the rocking member is turned through the movement of the driving wheel with respect to the guide member resulting from the relative angular movement between the first and the second turnable arms in the initial stage of the door opening operation to operate the unlocking device.

It is also possible to interlock a valve device capable of producing a hydraulic or pneumatic signal with the other end of the rocking member and to interlock the unlocking lever of the door locking device with a hydraulic or pneumatic servomotor designed to be actuated by the hydraulic or pneumatic signal. Furthermore, it is also possible to operate the unlocking lever by providing a switch so as to be actuated by the turning operation of the rocking member and a solenoid device interlocked with the unlocking lever and by closing or opening a circuit connecting the solenoid to a power source with the switch.

Furthermore, when the unlocking lever is operated by transmitting the turning motion of the rocking member to the unlocking device of the door locking device through a flexible cable, the door unlocking operation and the door opening operation can be carried out sequentially by means of a single prime mover.

Furthermore, for example, when the other end of the rocking member is placed in abutment against one side edge of an operating lever designed so as to be turnable about an axis extending perpendicularly to the axis of turning of the rocking member and the operating lever is connected to the unlocking lever of the door locking device provided for the door with a flexible cable, an increased stroke of the unlocking lever is available by means of a simple linkage.

In the present invention, any prime mover other than a DC motor, such as a hydraulic or pneumatic motor when a pressurized fluid source is available, is applicable provided that the prime mover is reversible, means for rotatively connecting the prime mover and the driving pulley is not limited to the gearing as shown in the drawings and belts as employed in the embodiments as described hereinbefore, chains, gearings or any other optional connecting means may be used for rotatively connecting those pulleys.

What is claimed as new and desired to be secured by Letters Patent of the United States is:

1. In a door operating device for a slide door unit including a wall having an opening formed therein, at least one curved guide rail fixedly extended along said wall and a door slidably associated with said guide rail by means of guide means so that the door is guided to be placed with the outside surface thereof arranged flush with the outside surface of said wall when the door closes the opening of said wall and the door is guided so as to slide along and in parallel to the outside surface of the wall when the door is opened, said door operating device comprising;

a guide member secured to the inside surface of said door and having a plate-shaped engaging flange extending in parallel to the sliding direction of the door;

a first turnable arm supported at the base portion thereof so as to be turnable within a horizontal plane on a stationary portion with respect to said wall;

a driving pulley supported on the base portion of said first turnable arm so as to be rotatable with respect to the first turnable arm;

a second turnable arm supported at the first end thereof on the free end of said first turnable arm with a first shaft so as to be turnable within a horizontal plane;

an intermediate pulley supported rotatably on said first shaft;

a third turnable arm supported at the first end thereof on the second end of said second turnable arm with a second shaft so as to be turnable within a horizontal plane;

a driven pulley rotatably supported on said second shaft;

a driving wheel fixed to said driven pulley so as to be turned together with said driven pulley;

a roller rotatably supported on the second end of said third turnable arm with a shaft extending in parallel to the axis of rotation of said driving wheel and adapted so as to engage with the engaging flange of said guide member and to receive the engaging flange closely between the roller and said driving wheel;

a prime mover;

a first torque transmitting means for transmitting the torque of the output shaft of said prime mover to said driving pulley; and a second torque transmitting means for transmitting the rotation of said driving pulley to said driven pulley through said intermediate pulley.

2. A door operating device according to claim 1, further comprising stopper means capable of restraining the angle between said first turnable arm and said second turnable arm from increasing over a predetermined angle and a stopper means capable of restraining said first turnable arm from turning over a predetermined angle from the position of the first turnable arm where the door closes said opening of the wall.

3. A door operating device according to claim 1, wherein said first turnable arm is supported rotatably at the base portion thereof on a shaft fixed to said stationary portion, said driving pulley is supported rotatably on said shaft, said prime mover is attached to said stationary portion and said first torque transmitting means includes a driven wheel secured concentrically to said driving pulley and a speed-reducing means formed between the output shaft of said prime mover and said driving pulley.

4. A door operating device according to claim 1, wherein said prime mover is mounted on the base portion of said first turnable arm and said first torque transmitting means includes a planetary reduction gear means comprising a sun gear driven for rotation by the output shaft of said prime mover, a ring gear concentrically secured to said driving pulley and planetary pinions rotatably supported on said stationary portion and engaging with said sun gear as well as said ring gear.

5. A door operating device according to claim 1, further comprising a rocking member supported rockingly on said guide member at a position near the front end of the guide member, with respect to the door opening direction, and having a strike head formed in one end thereof and protruded into the path of said roller along which the roller moves relatively to said guide member so as to strike against said roller, and connecting means for interconnecting the other end of said rocking member and the unlocking device of a door locking device provided on said door, whereby said roller strikes against the strike head of said rocking member to operate said unlocking device when said roller moves relatively to said guide member in a direction opposite the door opening direction in the initial stage of the door opening operation.

6. A door operating device according to claim 5, wherein said rocking member is supported rockingly on a supporting member secured to the door together with said guide member with a shaft extending in parallel to the axis of rotation of said roller and said connecting means includes an operating lever supported on said supporting member so as to be rotatable on a shaft extending perpendicularly to the shaft supporting said rocking member on said supporting member and resting with one end thereof in abutment against the other end of said rocking member, and a flexible wire interconnecting the other end of said operating lever and said unlocking device.

* * * * *